US007011610B2

(12) United States Patent
Wawrzyniak

(10) Patent No.: US 7,011,610 B2
(45) Date of Patent: Mar. 14, 2006

(54) ROLL-ABLE DUMBBELLS

(76) Inventor: Greg Wawrzyniak, 11292 Poblado Rd., San Diego, CA (US) 92127

( * ) Notice: Subject to any disclaimer, the term of this patent is extended or adjusted under 35 U.S.C. 154(b) by 0 days.

(21) Appl. No.: 10/798,497

(22) Filed: Mar. 10, 2004

(65) Prior Publication Data

US 2004/0180763 A1 Sep. 16, 2004

Related U.S. Application Data

(60) Provisional application No. 60/453,471, filed on Mar. 10, 2003.

(51) Int. Cl.
*A63B 21/00* (2006.01)

(52) U.S. Cl. ..... 482/106; 482/108; 482/104

(58) Field of Classification Search ..... 482/115, 482/132, 127, 95, 96, 907, 51, 106–108, 482/148, 141
See application file for complete search history.

(56) References Cited

U.S. PATENT DOCUMENTS 1,438,804 A * 12/1922 Albizu ..... 482/108
1,672,944 A * 6/1928 Jowett ..... 482/108
2,821,394 A * 1/1958 Barbeau ..... 482/132
3,134,590 A * 5/1964 Young ..... 482/132
5,004,229 A * 4/1991 Lind ..... 482/132
6,837,837 B1 * 1/2005 Nethery ..... 482/132

* cited by examiner

*Primary Examiner*—Jerome W. Donnelly
(74) *Attorney, Agent, or Firm*—Steins & Associates, P.C.

(57) ABSTRACT

Roll-able dumbbells are disclosed. An improved roll-able dumbbell utilizing gravitation and roll-resistance is presented having a handle and a plurality of circular weights attached to its ends. Regular dumbbells are generally held in hands and lifted up and down. The improved roll-able hand weights, in addition to providing benefits of a regular dumbbell, can be held and rolled against a variety of horizontal, slanted or vertical surfaces in a multitude of body positions. Each entire circular weight, its outer segments and/or the surface layer can rotate independently in respect to the handle. In addition, rotational resistance can be influenced by the user by tightening/loosening the end caps or other means. The total weight of the improved roll-able hand weights can also be adjusted by the user, who can select proper number and combination of individual components.

18 Claims, 5 Drawing Sheets

ROLL-ABLE DUMBBELLS

This application is filed within one year of, and claims priority to Provisional Application Ser. No. 60/453,471, filed Mar. 10, 2003.

BACKGROUND OF THE INVENTION

1. Field of the Invention

This invention relates generally to physical fitness and therapeutic devices and, more specifically, to Roll-able dumbbells 2. Description of Related Art Dumbbells are highly popular and very effective if used properly, but until now they have been utilized almost exclusively as weights. The roll-able hand-weights of the present invention are braking away from this unwritten rule and provide a tool for a multitude of additional workout routines, especially floor exercises aimed at shaping and strengthening primarily the arms and torso of the user. The roll-able dumbbells of the present invention can be used in prophylactic as well as therapeutic mobility and stretching exercises requiring a high degree of control.

There is a variety of highly specialized fitness equipment available on the market today. However, there is still a need for simple and more universal/multipurpose devices. Roll-able hand-weights of the present invention are designed to fill that need.

The roll-able dumbbells combine the advantages of the conventional dumbbells and a number of roll-able devices usually to strengthen abdominal area of the body. The "AB-slide" is a highly promoted on TV fitness gadget. It seems to be popular and effective but it is also known to have some adverse effects. Many users develop back pain after using the AB-Slide. The reason for that is because both arms of the user are "locked" onto the device and the torso muscles have to repeatedly initiate and maintain an unnatural one-dimensional/straight-line back and forth-movement.

It is more natural for the arms and torso muscles to follow curved lines and work in smaller groups independently, as it is the case when working out with dumbbells. The improved roll-able hand-weights of the present invention allow, and even encourage, this natural movement and make the muscle responses more predictable, more controllable and safer. Thus, the roll-able hand-weights open the field to a multitude of very attractive, effective and safer exercises.

The roll-able hand-weights come with an option to select the weight for each dumbbell to a desired level by attaching heavier circular weights, heavier end caps and/or a higher number of standard circular weights/wheels to each end of the handle.

In addition, the amount on drag on the rolling dumbbells can be regulated to suit the strength, fitness and comfort level of each individual user. The amount of drag should be selectable gradually between zero and the point of complete engagement or dialed incrementally between freewheeling, low resistance, medium resistance, high resistance and the locked position.

The improved weight-selectable hand-weights with adjustable roll-resistance of the present invention allow the user to utilize own body weight and to select the desired kind and level of exercise from a vast array of possibilities.

SUMMARY OF THE INVENTION

In light of the aforementioned problems associated with the prior devices, it is an object of the present invention to provide Roll-able dumbbells. In accordance with the present invention, there are provided improved hand weights with selectable weight and rolling capabilities. Weight can be adjusted by selecting proper size and number of specially weighted wheels. Wheels can rotate independently. Rotational resistance can be selected for each wheel individually via end caps.

An improved roll-able dumbbell utilizing gravitation and roll-resistance is presented having a soft grip around the midsection of the shaft and a plurality of circular weights/wheels attached to its ends. The handle consists of a padded grip segment and two reduced diameter, flattened or semi-circular shaft segments extending to each side and are internally threaded The circular weights are mounted on the shaft segments of the handle. The weights rotate preferably on a bearing and are sandwiched between friction discs/pressure plates. End-caps keep the weights/wheels in place. The end caps screw into the threaded opening at the end of each shaft and can be manually rotated to increase or reduce the rotational resistance of the circular weights via the pressure plates. A pair of improved roll-able dumbbells of the present invention can be used, besides regular lifting and flexing, for a multitude of highly effective floor exercises.

It is an object of the present invention to provide novel, simple, inexpensive/good value, durable and easily portable piece of exercise equipment with minimum bulk and mass, which can be used for a great variety of physical exercises and targeted workouts for different strength and fitness levels.

It is another object of the present invention to provide improved roll-able hand weights with selectable weight/weighted wheels for different fitness levels.

It is a more particular object of the present invention to provide improved roll-able hand weights that utilize body weight of the user to fortify the strength building effect on different muscle groups.

It is another more particular object of the present invention to provide improved roll-able hand weights that can be used for a variety of stretching exercises, thus improving joint strength, mobility and range of motion.

It is a still more particular object of the present invention to provide improved roll-able hand weights that enable users to simulate motions/movements and activate various muscle groups in a unique way not achievable by any other piece of equipment.

It is an even more particular object of the present invention to provide roll-able hand weights which can be used for a multitude of effective floor exercises and in addition, have a selectable amount of rotational resistance to allow better customization of individual workouts.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide Roll-able dumbbells.

There are numerous possible embodiments, which are encompassed by the scope of the present invention, but for the purpose of demonstrating the main novel features the following embodiment is discussed in greater detail.

Figure 1:
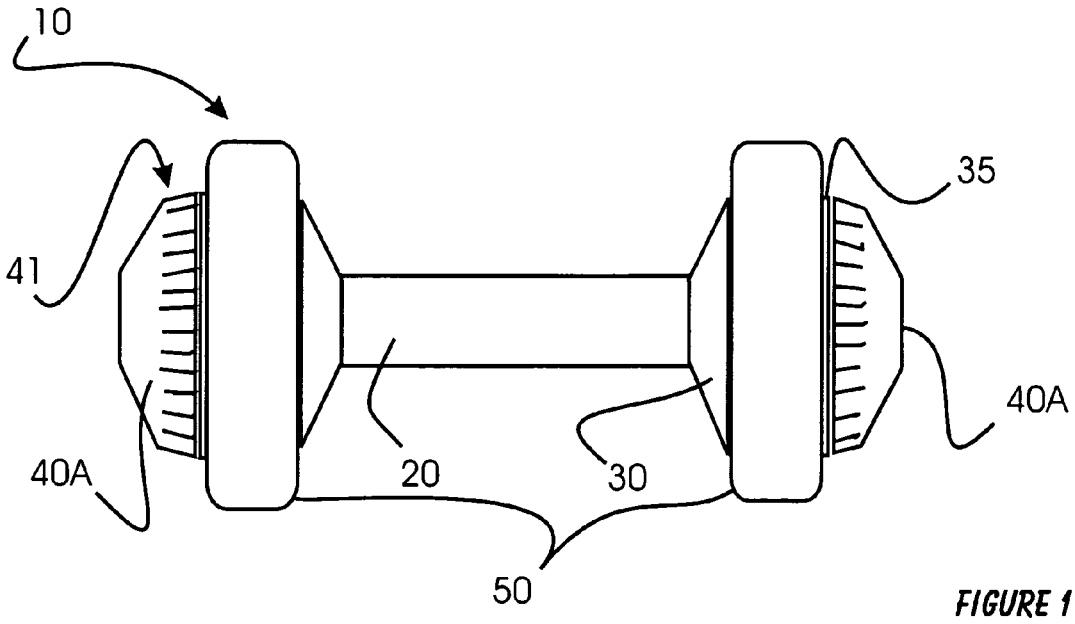
FIG. 1 is a front view of the improved roll-able dumbbell of the present invention.

The improved roll-able dumbbell 10 is shown in frontal view in FIG. 1 where it can be seen that a handle 20 connects to a tapered spacer 30, followed by circular weight 50, friction washer 35 and end-cap 40A on each side. The end-caps 40A show external ridges around the grip area 41. These ridges improve grip when the user manually rotates the end-caps. Tightening the end-caps 40A slightly against the friction washers 35 secures the end caps 40A in place.

Figure 2:
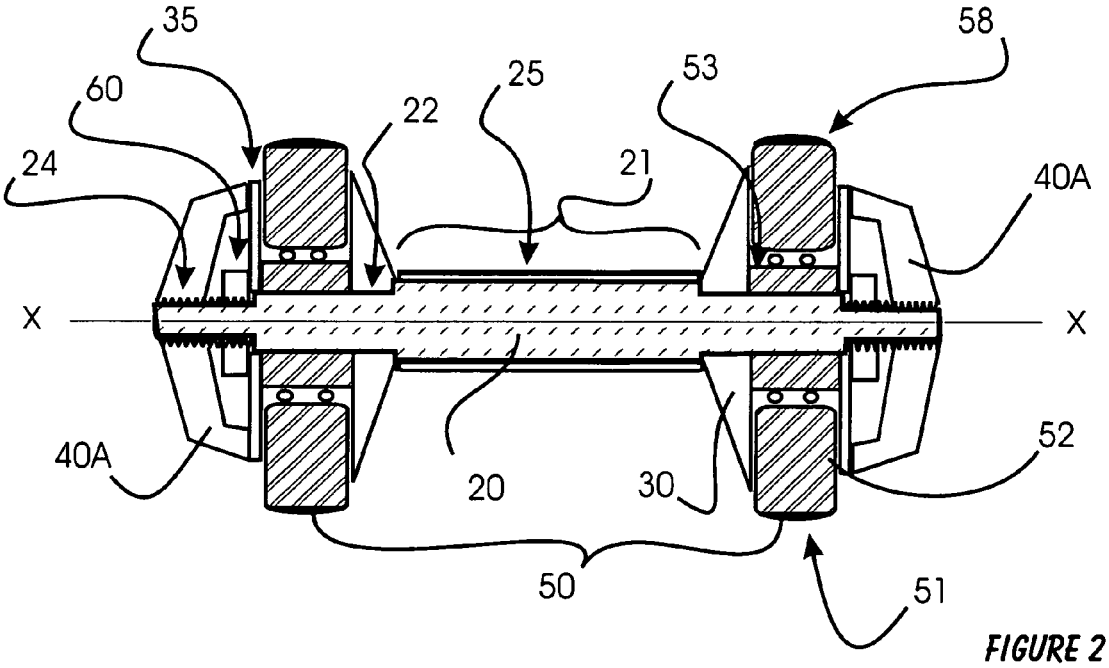
FIG. 2 is a cross-sectional side view of the roll-able dumbbell of FIG. 1, taken along the vertical plane on center axis.

A cross-section of dumbbell 10 is shown in FIG. 2 in which it is visible that the midsection 21 of the handle 20 is surrounded by the grip layer 25. The handle 20 extends from the midsection 21 and continues along the center axis X toward each side in a reduced diameter shaft 22 and terminates in a, further reduced in diameter, externally threaded section 24 on each end. The circular weight 50 consists of the inner ring 53, a plurality of rolling elements 58, the outer ring 52 and the external surface layer 51. This arrangement allows the outer ring 52 with the external surface layer 51 to rotate via rolling elements 58 around the inner ring 53. It can be seen that one circular weight 50, one tapered spacer 30 and one friction washer 35 is mounted on each shaft 22. It can also be seen that the internally threaded locknut 60 is screwed onto each of the externally threaded section 24 and pushes the friction washer 35 against the inner ring 53 thus securing the friction washer 35, the inner ring 53 and the tapered spacer 30 to the handle 20. The internally threaded light end-cap 40A is screwed onto the externally threaded section 24 as well.

When the user holds the improved dumbbell by the handle 20 firmly in the hand and rolls it on a surface (floor) either surface layer 51 makes contact with the floor and rotates together with either outer ring 52 independently of the handle 20 and all other components. Conversely, the handle 20 can be rotated independently by hand while the circular weights 50 remain in still contact with the surface. Since the circular weights 50 can also rotate independently from each other, any curve can be followed along the surface. Even circular motion of the entire dumbbell 10 around a vertical axis is possible. Those features allow the user to create and follow own natural motion patterns in highly individualized exercise routines instead of predetermined mechanical and one-dimensional movements many exercise machines require.

It is important that every piece of fitness equipment is to some degree adjustable and able to accommodate users of various body size, strength and fitness levels.

The improved roll-able dumbbell of the present invention addresses the problem by incorporating numerous options for weight and size variations. Noting that size and choice of material for the individual components of the improved roll-able dumbbell will naturally influence the weight of the entire unit, the focus of the discussion will remain on add-ons and interchangeability of components.

Figure 3:
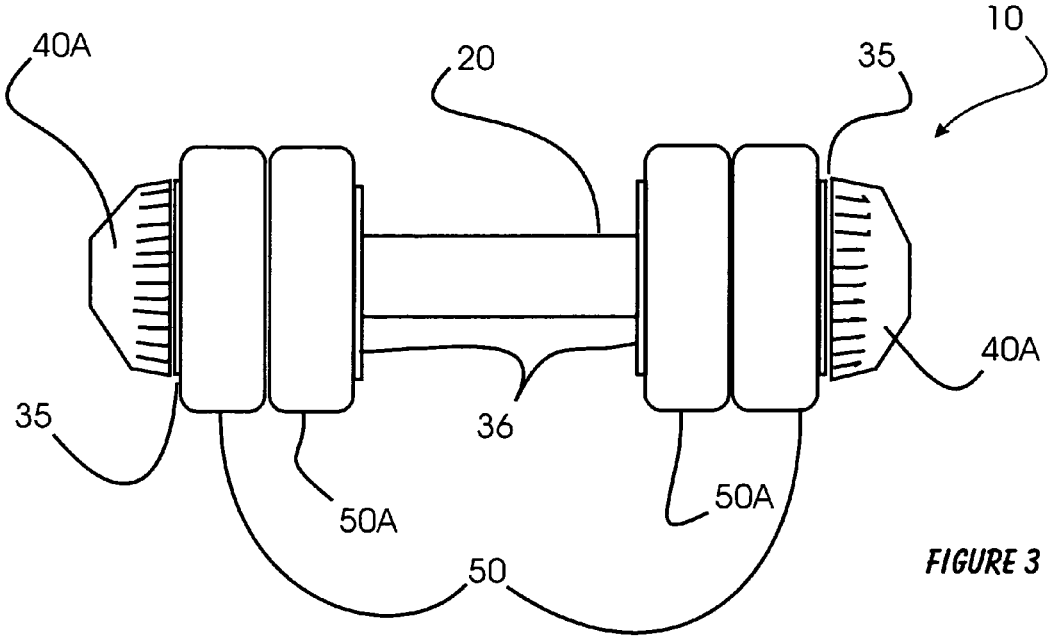
FIG. 3 is a front view of the improved roll-able dumbbell of FIGS. 1 and 2 with two circular weights on each side.

Looking at the FIG. 3 it can be noticed that the tapered spacers 30 have been replaced with a pair of washers 36 and an additional pair of circular weights 50 has been added to the dumbbell. This way the total weight of the dumbbell has been increased substantially.

Figure 4:
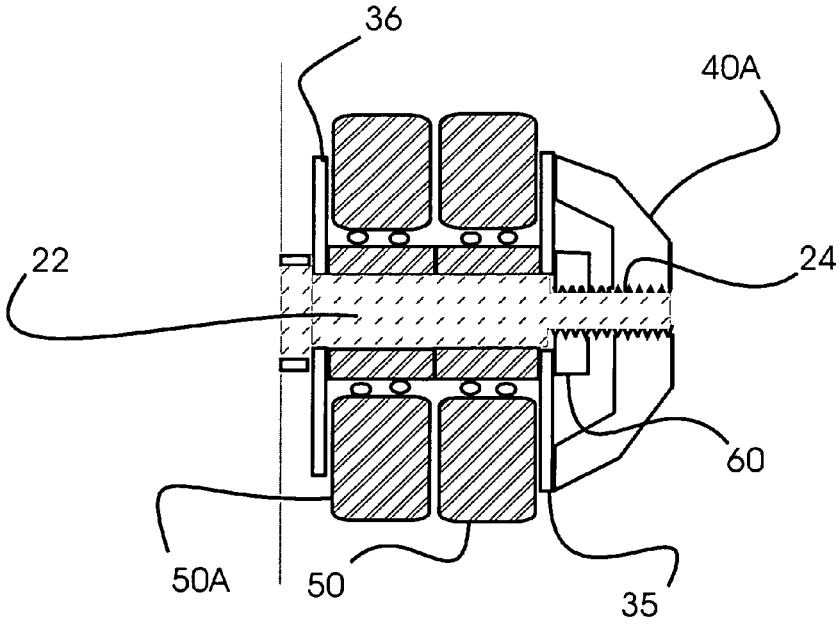
FIG. 4 is a partial front cross-sectional view of one end of the roll-able dumbbell of FIG. 3.

FIG. 4 gives a more detailed cross-sectional view of the right segment of the dumbbell from FIG. 3. This segment includes washer 36, a pair of circular weights 50 and friction washer 35 on the shaft 22 and lock nut 60 and the light end-cap 40A on the threaded section 24.

Figure 5:
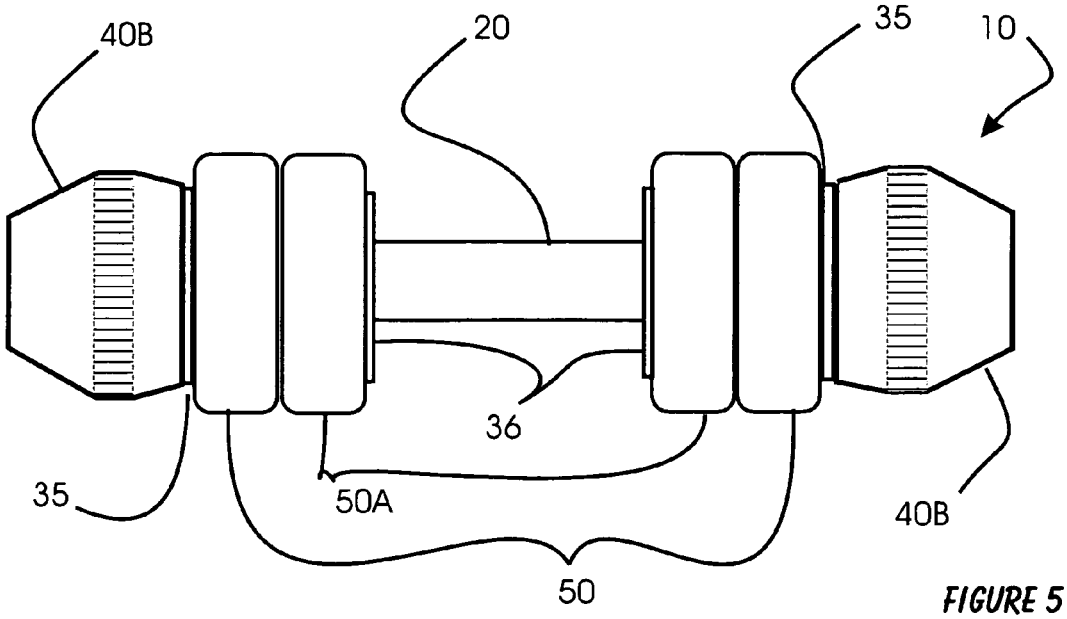
FIG. 5 is a front view of the improved roll-able dumbbell of the present invention with two circular weights and a heavy end cap on each side.

FIG. 5 shows the improved roll-able dumbbell 10 of the present invention as in FIG. 3 but with the exception that here the light end caps 40A have been replaced with the heavy end caps 40B. This further increases the total weight of the dumbbell.

Figure 6:
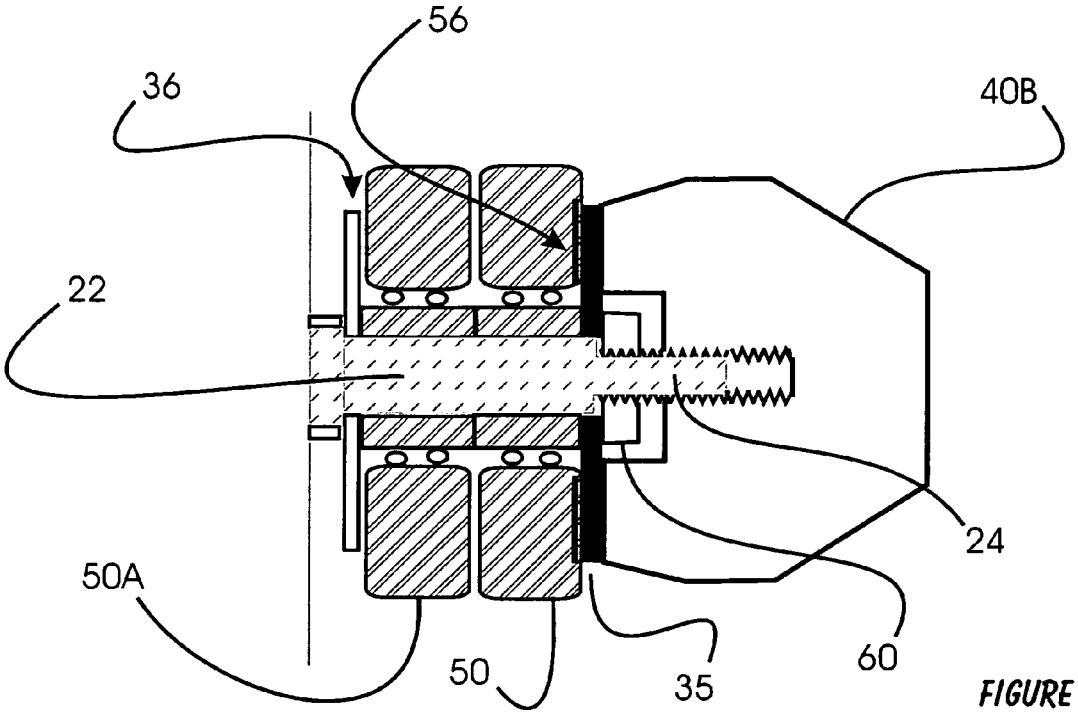
FIG. 6 is a partial front cross-sectional view of one end of the roll-able dumbbell of FIG. 5.

FIG. 6 gives a more detailed cross-sectional view of the right segment of the dumbbell from FIG. 5.

Figure 7:
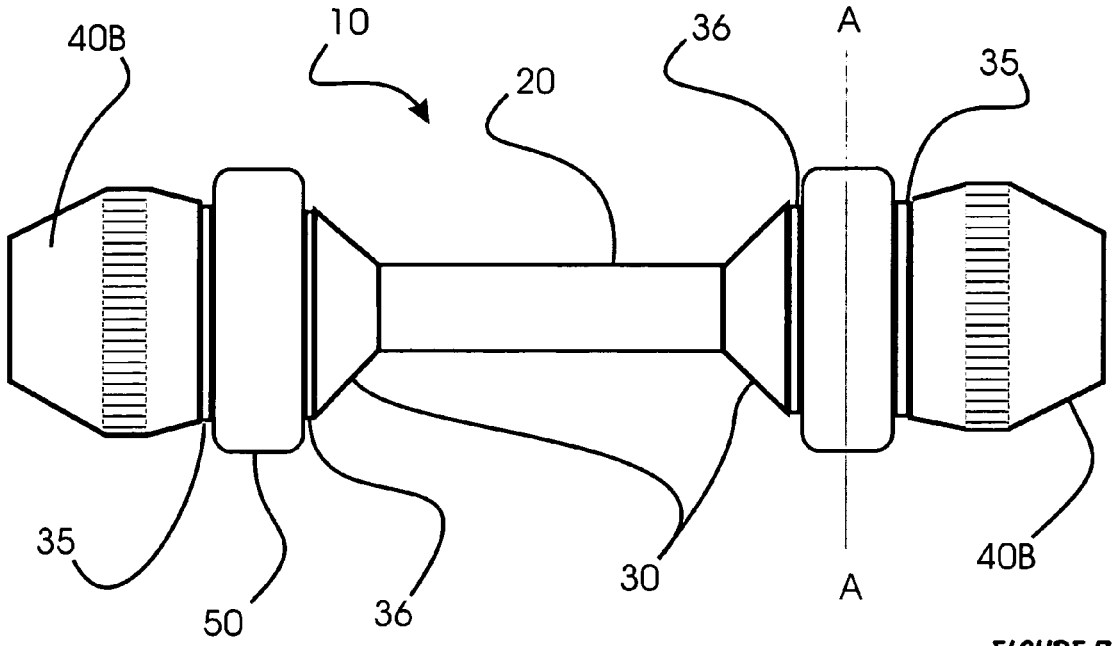
FIG. 7 is a front view of the roll-able dumbbell of FIGS. 5 and 6 with one circular weight and a heavy end cap on each side.

To further illustrate another possible combination of components influencing the weight of the dumbbell 10, FIG. 7 shows the improved roll-able dumbbell of the present invention with heavy end caps 40B, single circular weight 50 and tapered spacers 30 on each side of the handle 20.

Figure 8:
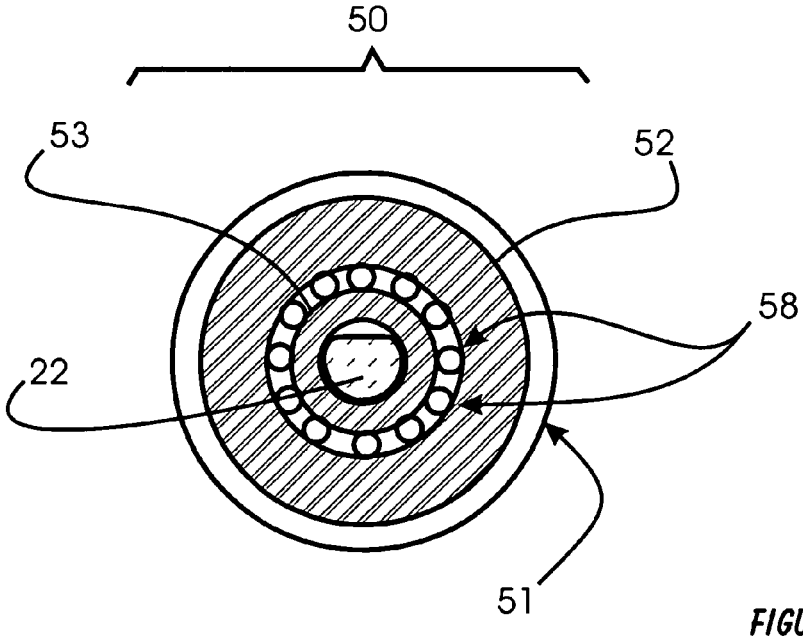
FIG. 8 is a cross-sectional side view of the roll-able dumbbell of FIG. 7 along vertical plane A.

FIG. 8 shows a cross-sectional view of the circular roll-able weight 50 on the shaft 22 and demonstrates how the inner ring 53 and the outer ring 52 can rotate independently via the rolling elements 58. A closer look at the profile of shaft 22 reveals that the profile is not completely circular. The reason behind it is that it is necessary for the tapered spacers, and friction washers, which have a central hole matching the profile of the shaft, to be fixed in respect to the shaft and not rotate with the outer ring 52.

Turning now to the friction mechanism of the present invention we will need to go back and take another look at the FIG. 6. It can be seen that the circular weight 50 consists of the inner ring 53, a plurality of rolling elements 58, the outer ring 52 with the friction surface 56 and the surface layer 51.

Tightening the internally threaded end-caps 40B slightly against the friction washer 35 secures the end caps 40B in place. Tightening the end-caps 40B further causes the friction washers 35 to move/bend toward the sidewall 56 of the outer ring 52 and apply force, thus producing surface friction between the friction disc 35 and the sidewall 56 of the outer ring 52 resulting in gradually increasing rotational resistance on the circular weight 50. The friction can be gradually increased to the point, where the rotation of the circular weight 50 is completely inhibited. The "friction engagement position" in which the friction washer 35 is clearly in contact with the sidewall 56 of the outer ring 52 is shown in FIGS. 5, 6 and 7. Conversely, the friction can be reduced gradually by turning the end-cap in the opposite direction to the point, where friction washer 35 is no more in contact with the sidewall 56 of the outer ring 52 and the circular weight 50 can rotate freely as shown in FIGS. 1, 2, 3, and 4.

Figure 9:
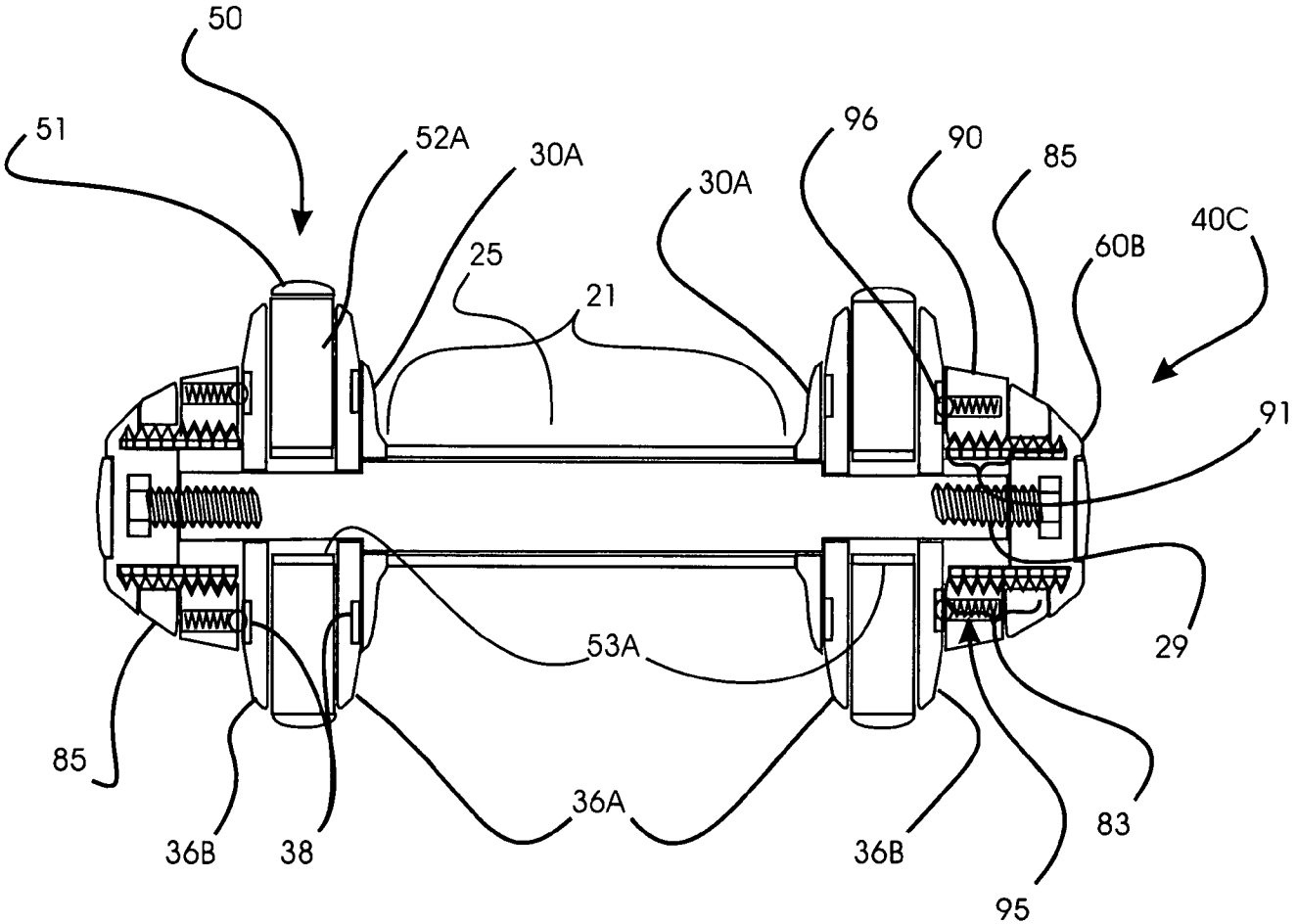
FIG. 9 is a front cross-sectional view of another alternate embodiment of the roll-able dumbbell of the present invention.

FIG. 9 depicts the device of the present invention having an alternate end cap and wheel design. As shown here, friction (rotational resistance) in this embodiment can be also adjusted incrementally by having ball-elements 96 incorporated into the tension collar 90 as shown in FIG. 9. The ball-plungers 96 lock into indentations 38 formed on the outer surfaces of the wheels 50. In this version, the wheels 50 are bounded by new rings 36A and 36B; these function as pressure plates to distribute the force created by the tension collars 90 across the faces (both inner and outer) of the wheels 50. By dispersing these ball-detents around the circular face of the plates 36B, it should be apparent that the tension collar 90 will be caused to stop in its rotation every time a ball element 96 reaches an indentation in the plate 36B. This provides the user will good tactile sensation as he or she tightens the tension collars 90, as well as retaining the tension collars 90 in the positions that they are left in. Because the ball elements 96 are biased against the plates 36B by biasing elements 95, such as the springs shown, it is a simple matter to twist the tension collar 90 with additional force, which will cause the ball elements 96 to be forced into the bores formed in the tension collars 90 (until such time as the tension collar is rotated to a point where another indentation in the plates 36B aligns with the ball element).

The locking cap 60B has and externally threaded bolt 29 embedded within it. The bolt 29 locks onto the handle end, like the lock nut 60 previously described in connection with other drawing figures, and has among its functions preventing the circular weights/wheels 50 and the pressure plates 36 from sliding off of the shaft. Furthermore, and as discussed above in the discussion connected with FIG. 8, the handle end portion 22 may have a flattened side—the pressure plates 36 (in these circumstances) will have a corresponding flat side as well. The engagement of these two flat sides will prevent the pressure plates 36 from rotating relative to the handle end 22 (i.e. when the wheels rotate).

The externally threaded section 83 of the locking cap 60B is designed to receive the internally threaded portion 91 of the tension collar 90. Of course, the result is that turning the tension collar 90 will cause the engaged threads 91 to drive the collar 90 towards or away from the wheels 50, thereby either increasing or decreasing the friction force between the elements (and the resistance to rolling in the wheels 50).

The foam ring 85 covers the remaining threaded section of the locking cap 60B and helps retain the tension collar 90 against excessive retracting and wobbling in retracted position.

There are many options as to how rotational resistance/drag on the circular weights can be produced and adjusted. There can be a plurality of friction disks on each side of the weights. Also coil or spring tension, among other things can be utilized to create desired effect. There are also numerous ways to achieve rotation on the circular weights and to influence the total weight of the roll-able hand weights.

The present embodiments of this invention are thus to be considered in all respects as illustrative and not restrictive; the scope of the invention being indicated by the appended claims rather than by the foregoing description.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A dumbbell, comprising:

a handle defined by a pair of opposing ends;

a pair of end cap assemblies, each said assembly threadedly engaging one said end wherein each said end cap assembly comprises a locking cap, said locking cap threadedly engaging said handle, said locking cap comprising a central bore for accepting said handle end therein and an externally threaded portion surrounding and is spaced relation with said central bore; and a pair of wheels, each said wheel slidingly engaging said handle generally adjacent to one said end, each said wheel comprising an outer ring defining a circular outer periphery and a central bore, said central bore defined by rolling means for permitting said wheel to rotate about said handle, and friction-creating means for resisting said rolling.

2. The dumbbell of claim 1, wherein each said end cap assembly further comprises a tension collar, said tension collar comprising said friction creating means and further defined by a central threaded bore configured to cooperate with said externally threaded portion of said locking cap.

3. The dumbbell of claim 1, wherein said friction-creating means comprises a friction ring captured between said wheel and said end cap assembly.

4. The dumbbell of claim 2, wherein:

each said wheel further defines inner and outer sides, said inner and outer sides being substantially coplanar in a plane perpendicular to an axis defined by said central bore of said wheels; and said friction-creating means comprising one or more indentations disposed on said outer surface, said indentations configured to accept one or more ball elements captured between said outer surface and said end cap assembly.

5. The dumbbell of claim 4, wherein each said tension collar further comprises one ball-detent receptacle formed in said tension collar to accept one said ball element therein, said ball-detent receptacle further comprising a biasing element for biasing said ball element towards said outer side of said wheel.

6. The dumbbell of claim 5, wherein each said end cap assembly further comprises a foam ring between said locking cap and said tension collar.

7. The dumbbell of claim 6, wherein each said wheel comprises a friction coating around said substantially circular periphery.

8. The dumbbell of claim 7, comprising a pair of said wheels at each said handle end.

9. An exercise device, comprising:

a handle defined by a center portion and a pair of opposing ends, said center portion defining a generally circular cross-section and said opposing ends each defined by a generally circular cross-section but having a flattened side in a plane parallel to an axis defined by said handle;

a pair of handle rings surrounding said handle between said center portion and said end portions;

a pair of end cap assemblies, each said assembly threadedly engaging one said end; and a pair of wheels, each said wheel slidingly engaging said handle generally adjacent to one said end, each said wheel comprising an outer ring defining a circular outer periphery and a central bore, said central bore defined by rolling means for permitting said wheel to rotate about said handle, and friction-creating means for resisting said rolling.

10. The device of claim 9, wherein each said end cap assembly comprises a locking cap, each said locking cap threadedly engaging end portion of said handle.

11. The device of claim 10, wherein each said locking cap comprises a central bore for accepting said handle end therein and an externally threaded portion surrounding and in spaced relation with said central bore.

12. The device of claim 11, wherein each said end cap assembly further comprises a tension collar, said tension collar comprising said friction creating means and further defined by a central threaded bore configured to cooperate with said externally threaded portion of said locking cap.

13. The device of claim 12, wherein:

each said wheel further defines inner and outer sides, said inner and outer sides being substantially coplanar in a plane perpendicular to an axis defined by said central bore of said wheels; and said friction-creating means comprising one or more indentations disposed on said outer surface, said indentations configured to accept one or more ball elements captured between said outer surface and said end cap assembly.

14. The device of claim 13, wherein each said tension collar further comprises one ball-detent receptacle formed in said tension collar to accept one said ball element therein, said ball-detent receptacle further comprising a biasing element for biasing said ball element towards said outer side of said wheel.

15. The device of claim 14, wherein each said end cap assembly further comprises a foam ring between said locking cap and said tension collar.

16. The device of claim 15, wherein each said wheel comprises a friction coating around said substantially circular periphery.

17. The device of claim 16, comprising a pair of said wheels at each said handle end.

18. The device of claim 10, wherein said friction-creating means comprises a friction ring captured between said wheel and said end cap assembly.

* * * * *